United States Patent [19]

Micallef

[11] 3,967,765

[45] July 6, 1976

[54] MULTIPLE PURPOSE NOZZLE

[75] Inventor: Lewis A. Micallef, Fort Lee, N.J.

[73] Assignee: Leeds and Micallef, Fort Lee, N.J.

[22] Filed: Sept. 30, 1974

[21] Appl. No.: 510,580

Related U.S. Application Data

[63] Continuation-in-part of Ser. No. 278,997, Aug. 9, 1972, Pat. No. 3,843,030.

[52] U.S. Cl. ..... 222/554; 239/478; 239/538

[51] Int. Cl.[2] ..... B05B 1/12

[58] Field of Search ..... 222/548, 554; 239/478, 239/479, 538, 492

[56] References Cited

UNITED STATES PATENTS

| | | | |
|---|---|---|---|
| 3,118,578 | 1/1964 | Collins | 222/548 |
| 3,149,755 | 9/1964 | Porter et al. | 222/548 X |
| 3,170,633 | 2/1965 | Castelli | 239/436 X |
| 3,204,836 | 9/1965 | Joffe | 222/548 X |

FOREIGN PATENTS OR APPLICATIONS

| | | | |
|---|---|---|---|
| 980,392 | 1/1965 | United Kingdom | 222/548 |

*Primary Examiner*—Robert B. Reeves
*Assistant Examiner*—Frederick R. Handren
*Attorney, Agent, or Firm*—Kane, Dalsimer, Kane, Sullivan and Kurucz

[57] ABSTRACT

A nozzle located at the discharge end of a container includes a tubular member and a cap thereon. The tubular member has a passage in communication with the container interior for passage therethrough of the container contents to be dispensed. The cap is adjustably mounted on the tubular member and is capable of being turned to a first position at which the passage of the tubular member is closed to prevent the passage of the material to be dispensed. The cap is adapted to be turned to a plurality of discharge positions depending upon the discharge pattern desired. In these positions the passage is open and is placed in communication with a discharge opening and surrounding recesses in the closed end of the cap through a passageway defined by cooperating surfaces of a slotted core portion and surrounding slotted core skirt of the tubular member and a slotted boss cooperating with the core and skirt of the tubular member when the cap is assembled to the tubular member. Variation of the relationship between the slots adjust the flow of fluid between a no-flow position, a variety of spray positions, and a steady stream position.

5 Claims, 10 Drawing Figures

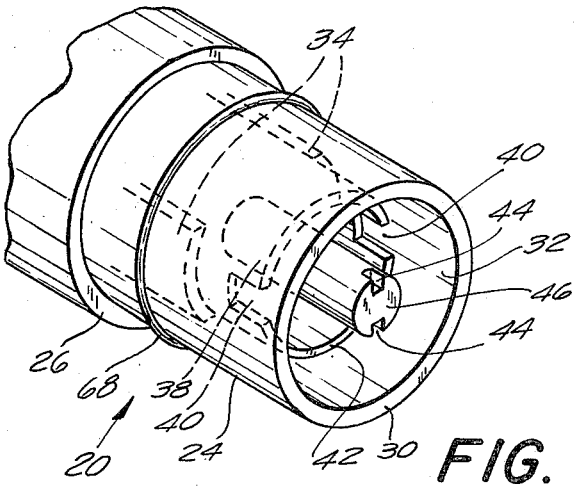
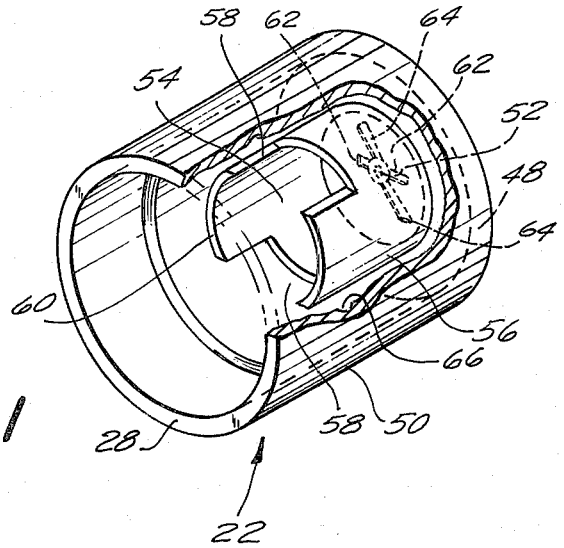
FIG. 1
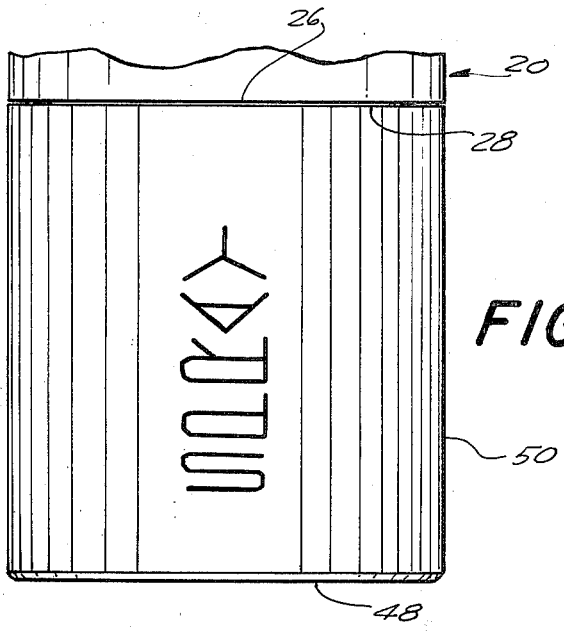
FIG. 3
FIG. 2
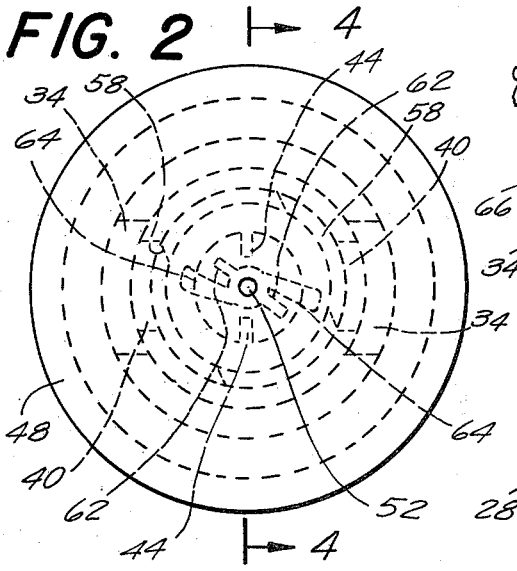
FIG. 4
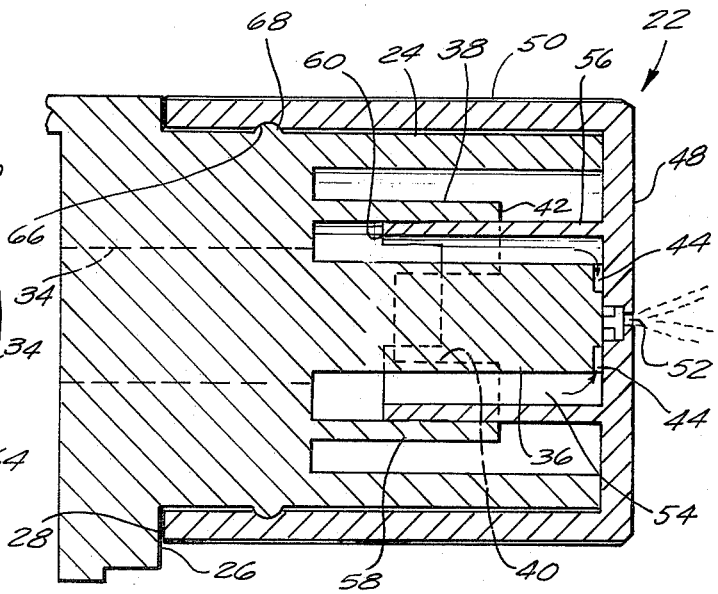

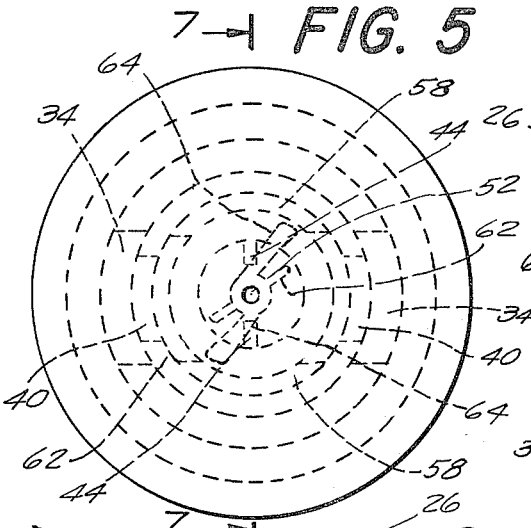
FIG. 5
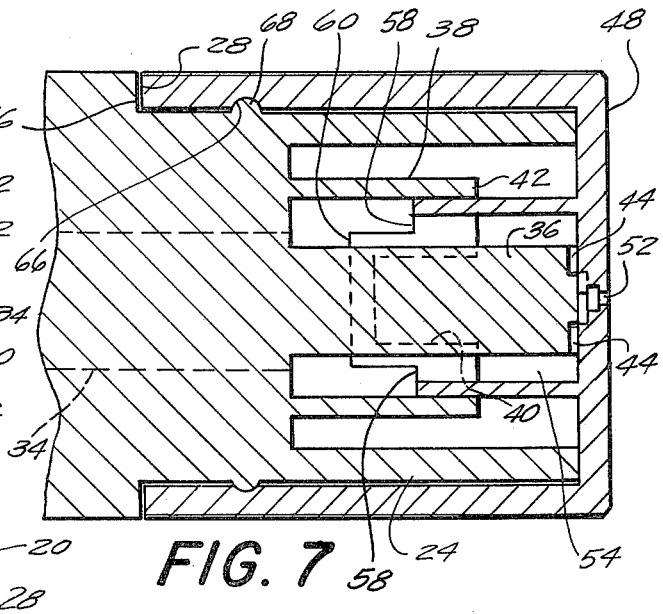
FIG. 7
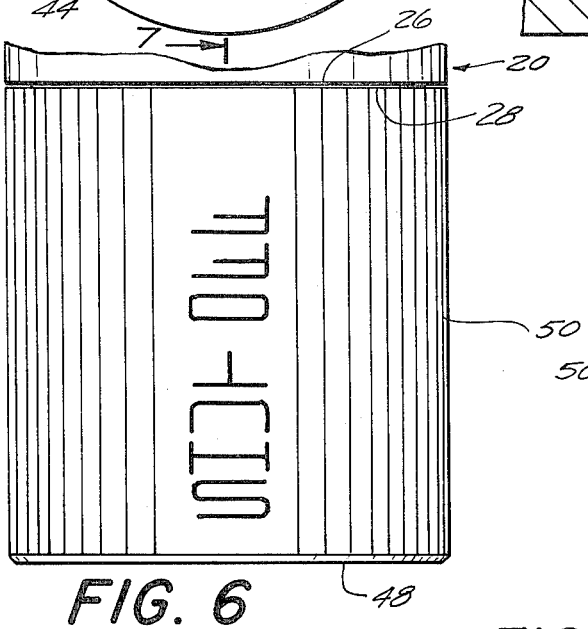
FIG. 6
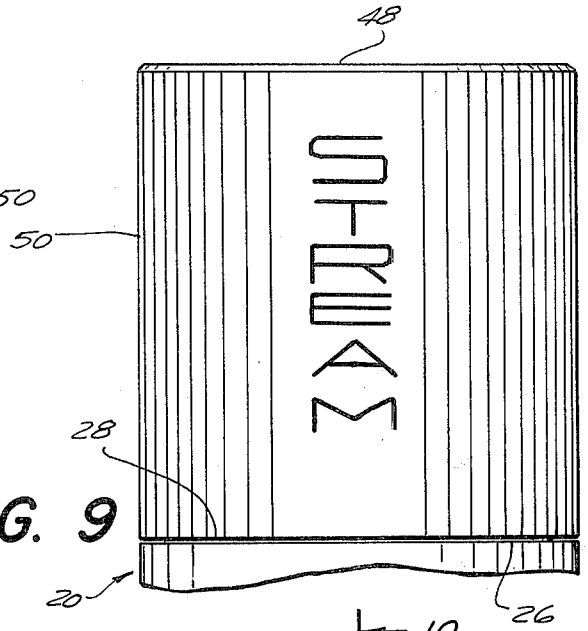
FIG. 9
FIG. 10
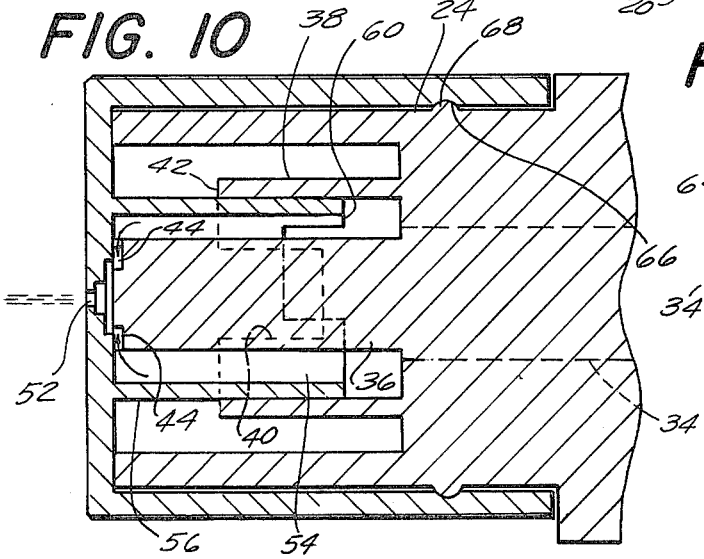
FIG. 8
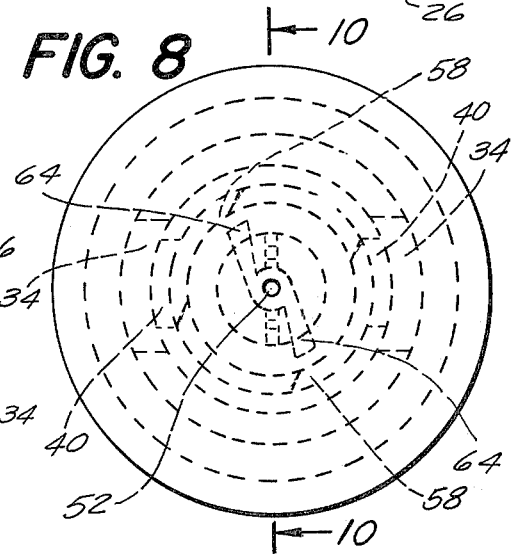

MULTIPLE PURPOSE NOZZLE

CROSS REFERENCE TO RELATED APPLICATIONS

This application is a continuation in part of patent application Ser. No. 278,997 filed August 9, 1972, now patent No. 3,843,030, the contents of which are incorporated herein by reference.

BACKGROUND OF THE INVENTION

Products to be dispensed, such as consumer products, are generally contained in a variety of packages. Some are dispensed from "squeeze" bottles, containers bearing pumps or other product propelling mechanisms. In most instances, the discharging mechanisms are protected against accidental product discharge or leakage either during shipment, storage or display on retail shelves or racks. For such purposes, safety or overcaps, pins and plugs among other approaches have been employed with various degrees of success. Some have been ineffectual for one reason or another, while others costly because of the relatively high expense of manufacture. More importantly, once the safety mechanism was de-activated, the product could thereafter be accidentally or inadvertently discharged. In addition, the available discharge pattern of the prior art packages were as a rule fixed and not selectively variable by the consumer.

SUMMARY OF THE INVENTION

It is a principal object of the present invention to provide a multi-purpose nozzle for the discharge mechanism of bottles or containers which may assume a first position at which the mechanism is closed or sealed against premature, accidental or inadvertent discharge or leakage of the product to be dispensed and one or more other positions at which the product may be dispensed in a corresponding number of discharge patterns depending upon the selection of the consumer.

Another object is to provide a multi-purpose nozzle of the foregoing type that embodies relatively few parts, each individually simple and inexpensive to manufacture and assemble, thereby maintaining nozzle cost at an absolute minimun.

Other objects and advantages will become apparent from the following detailed description of the invention which is to be taken in conjunction with the accompanying drawings.

BRIEF DESCRIPTION OF THE DRAWINGS

In the drawings:

FIG. 1 is an exploded perspective view of a multi-purpose nozzle of this invention embodying only two parts with central portions broken away, removed and sectioned;

FIG. 2 is a front view of the parts assembled with the nozzle in a spraying position;

FIG. 3 is a top view thereof;

FIG. 4 is a longitudinal sectional view taken along the line of 4—4 of FIG. 2;

FIG. 5 is a front view of the assembled nozzle turned to a closed or sealed position at which the product cannot be dispensed;

FIG. 6 is a top view thereof;

FIG. 7 is a longitudinal sectional view taken along the line 7—7 of FIG. 5;

FIG. 8 is a front view of the assembled nozzle turned to a position at which the product may be discharged in a stream;

FIG. 9 is a top view thereof; and

FIG. 10 is a longitudinal sectional view taken along the line 10—10 of FIG. 8.

DETAILED DESCRIPTION OF THE PREFERRED EMBODIMENTS

The multi-purpose nozzle illustrated in the drawings is comprised of only two parts, tubular member 20 and cap 22. Tubular member 20 may form part or be an integral extension of the discharge end of a dispenser which may assume any one of a number of varieties, as for example, a pump actuated dispenser, aerosol dispenser or squeeze bottle type of dispenser, to mention a few. Tubular member 20 is provided with a tubular extension 24 of lesser diameter than the remainder of the exterior of tubular member 20 so as to form a shoulder 26 to receive rim 28 of cap 22. Thus, when cap 22 is fully seated on tubular member 20, rim 28 will be in engagement with shoulder 26 while permitting relative rotation between the cap and the tubular member. If desired, appropriate spaced stop shoulders can be positioned on the tubular member 20 and on cap 22 to define various discharge positions when orienting the nozzle in one of its plurality of discharge positions.

Tubular extension 24 includes a free end 30 having a central opening 32 which extends into communication with a pair of opposed channels 34 which communicate with the source of fluid to be dispensed. Centrally located within tubular extension 24 is a cylindrical core portion 36. The core portion is preferably positioned coaxially with respect to the remainder of tubular member 20. Surrounding core portion 36 and coaxially positioned with respect thereto is a core skirt 38. Tubular extension 24 coaxially surrounds core skirt 38. A pair of opposed notches 40 are located in core skirt 38 adjacent the exposed rim 42 thereof. Skirt 38 is spaced from tubular extension 24 so as to provide a continuous passageway therebetween from channels 34.

Core 36 extends beyond edge 42 of skirt 38 and has a pair of opposed notches 44 in its end wall 46. When all of the slots in tubular member 20 are exposed, fluid can flow from channels 34 through slots 40 in skirt 38 and through notches 44 and the end portion of core 36.

Cap 22 is adapted to be rotatably disposed about tubular extension 24 between a closed position at which the material to be dispensed is sealed and may not be discharged and either of two dispensing positions for discharging a spray or stream. Cap 22 includes a substantially flat end wall 48 from which extends a tubular skirt 50. The skirt 50 terminates in a rim 28 which is adapted to seat on shoulder 26 of tubular member 20. End wall 48 is provided with a discharge orifice 52 which is in communication with the hollow interior 54 of a centrally located boss 56 extending inwardly from end wall 48. Boss 56 is open in a direction opposed to end wall 48 and includes a pair of opposed slots 58 which are open to end rim 60 of boss 56.

The chamber 54 within boss 56 is large enough to receive core portion 36 therein in rotational relationship when cap 22 is positioned on tubular member 20. Additionally, the diameter of boss 56 is less than the inner diameter of core skirt 38 so that the side walls of boss 56 are received within skirt 38 when the cap is interengaged with the tubular member.

On the inner surface of end wall 48 adjacent to outlet orifice 52 is a pattern of recesses through which fluid flows when traveling from tubular member 20 to outlet orifice 52. Included in the pattern of recesses are a pair of opposed shorter legs 62 which are of lesser length than the diameter of core 36. Angularly spaced from the shorter legs 62 are a pair of longer recesses 64 which extend slightly further than the outer diameter of core 36 so as to be slightly exposed beyond the core when the cap is coupled to the tubular member. All of the recesses 62 and 64 communicate with orifice 52. Rotation of cap 22 with respect to tubular member 20 determines the communicating or non-communicating relationship between slots 58 in boss 56, slots 40 in skirt 38, notches 44 in core 36, and the pattern of recesses on the inner surface of end wall 48 adjacent to orifice 52 thereby controlling the flow of fluid through the slots from channels 34 and out through orifice opening 52.

The inner wall of skirt 50 may include a continuous recess 66 which is adapted to accommodate the continuous bead 68 upon extension 24 in securing the cap on this extension.

When cap 22 is rotated so that slots 58 were not in alignment with slots 40 of core skirt 38, the walls of boss 56 close off slots 40 thereby closing the communicating passageway between channels 34 and the interior of skirt 38. In this position, the material to be dispensed is not permitted to travel from tubular member 20 through cap 22 and out orifice opening 52.

In operation in assuming that it is desired to initially dispense a product in a spray pattern, cap 22 will be turned and oriented on tubular member as shown in FIGS. 2–4. In this position, the product is adapted to pass from channels 34 into slots 40 of skirt 38, through aligned slots 58 of boss 56 with the passage through the slots being substantially lateral in direction. The product then enters the extreme edges of longer recess legs 64 which extend beyond the end wall 46 of core 36. The product then passes through orifice 52 as a spray. The spray result is provided by means of the tortuous passage into the extreme edges of legs 64 and then through the non-uniform passageway of legs 64 until it reaches orifice 52. It should be noted that there is no communication between notches 44 in core 36 and either recess leg 62 or 64 in the end wall of the cap. Therefore, the only exit for the product is through the tortuous path as described above.

Upon turning and rotating of the cap in a counterclockwise direction to an intermediate position, the side walls of boss 56 are brought into alignment with slots 40 in skirt 38 thereby sealing off the passage for the products through slots 40 and preventing any discharge of the product through orifice 52. This arrangement is depicted in FIGS. 5–7.

Upon turning of the cap 22 a further distance until slots 58 are once again in alignment with slots 40 of skirt 38 and with notches 44 in alignment and in communication with shorter recess legs 62, a complete opening for fluid is provided for dispensing fluid from channels 34 through aligned slots 40 and 58 and through aligned notches 44 and recess legs 62 as a stream through outlet orifice 52. This arrangement is depicted in FIGS. 8–10. When it is desired to seal off the passageway once again, the cap may only be turned in either direction to an intermediate position where once again the walls of boss 56 close the passageway through notches 40 in skirt 38 preventing passage from channels 34 through orifice 52.

In certain applications such as when lotions are dispensed, it sometime may be desirable to dispense with the end portion of core 36 containing notches 44 and the pattern of recesses in end wall 48 of the cap adjacent to orifice 52. With this configuration, there is space between the end wall of core 36 and the end wall 48 of cap 22. Therefore, when notches 40 in skirt 38 are aligned with notches 58 in boss 56, lotion can flow through channels 34, through the aligned notches and into the space between the end wall of core 36 and end wall 48 and, exit through nozzle orifice 52. When cap 22 is rotated so that notches 58 are out of alignment with notches 40 in skirt 38, the walls of boss 56 prevent lotion from flowing between channels 34 and orifice 52.

Thus, the several aforenoted objects and advantages are most effectively attained. Although a single, somewhat preferred embodiment of the invention has been disclosed and described in detail herein, it should be understood that this invention is in no sense limited thereby and its scope is to be determined by that of the appended claims.

I claim:

1. A multiple purpose nozzle comprising: a tubular member having a passage means therethrough and through which material to be dispensed is adapted to pass, an adjustable cap associated with the tubular member and adapted to assume a first position at which it seals off the passage means to prevent the material form being dispensed, the cap adapted to assume at least one other position at which the material to be dispensed is adapted to pass in a selected predetermined discharge pattern, the cap including a discharge orifice, surfaces of the tubular member and the cap define a passageway from the passage means to the orifice when the cap is in the other position, the tubular member having an end wall, the cap having an outer flat closed wall having the discharge orifice and a tubular skirt disposed around the end wall, the cap and the tubular member cooperating to form between them a laterally extending portion of said passageway when the cap is in the other position, the passageway including a cavity of predetermined configuration at the other position which cooperates with the orifice in producing the selected discharge pattern, the cap including a hollow boss extending from the flat wall inwardly within and coaxially with the skirt, an axially extending core portion and a surrounding spaced core skirt in the tubular member and positioned to receive the boss therebetween when the cap is coupled with the tubular member, the boss and core skirt having cooperating slots forming part of the passageway communicating with the passage means and the cavity when the cap is in the other position, the boss being adapted to close off the passage means and its communication with the orifice when the cap is in the first position, and coupling means for associating the cap with the tubular member whereby the cap may be shifted between the first and second positions there being at least two other positions angularly spaced with the discharge pattern of one being a spray and the discharge pattern of the other being a stream, the boss, core skirt, and core having slots therein cooperating with recesses in the flat closed wall of the cap upon alignment in a first of said other portions that produces a stream through the discharge orifice and alignment in a second of said other positions that produces a mechanical break-up to provide a spray pattern through the discharge orifice.

2. A multiple purpose nozzle in accordance with claim 1, wherein the coupling means includes a continuous laterally projecting bead and accommodating continuous recess extending normal to the axis of the tubular member to cooperate in securing the cap on the tubular member.

3. A multiple purpose nozzle in accordance with claim 1, wherein the end wall of the tubular member and the flat closed wall of the cap being essentially in the same plane throughout the traverse of the cap between the first and other positions.

4. A multiple purpose nozzle comprising: a tubular member having a passage means therethrough and through which material to be dispensed is adapted to pass, an adjustable cap associated with the tubular member and adapted to assume a first position at which it seals off the passage means to prevent the material from being dispensed, the cap adapted to assume at least one other position at which the material to be dispensed is adapted to pass in a selected predetermined discharge pattern, the cap including a discharge orifice, surfaces of the tubular member and the cap define a passageway from the passage means to the orifice when the cap is in the other position, the tubular member having an end wall, the cap having an outer flat closed wall having the discharge orifice and a tubular skirt disposed around the end wall, the cap and the tubular member cooperating to form between them a laterally extending portion of said passageway when the cap is in the other position, the passageway including a cavity of predetermined configuration at the other position which cooperates with the orifice in producing the selected discharge pattern, the cap including a hollow boss extending from the flat wall inwardly within and coaxially with the skirt, an axially extending core portion and a surrounding spaced core skirt in the tubular member and positioned to receive the boss therebetween when the cap is coupled with the tubular member, the boss and core skirt having cooperating slots forming part of the passageway communicating with the passage means and the cavity when the cap is in the other position, the boss being adapted to close off the passage means and its communication with the orifice when the cap is in the first position, and coupling means for associating the cap with the tubular member whereby the cap may be shifted between the first and second positions, there being at least two other positions angularly spaced with the discharge pattern of one being a spray and the other pattern being a stream, the boss having two diametrically opposed slots therein, the core skirt having two diametrically opposed slots therein, the core portion having two diametrically opposed slots therein, the flat closed wall of the cap having a pattern of recesses adjacent to and communicating with the orifice therein, the slots of the boss, core skirt, and core and the recesses in the flat closed wall of the cap being positioned so that when the slots of the boss are fully aligned with the slots of the core skirt, the slots in the core will be aligned with the recesses adjacent the orifice of the cap, the interconnected openings cooperating in assisting to produce a stream through the discharge orifice and when the slots in the boss and the slots in the core skirt are aligned and the slots in the core and the recesses in the closed wall of the cap are not aligned, the openings cooperate in assisting to produce a mechanical break-up to provide a spray pattern through the discharge orifice.

5. The invention in accordance with claim 4, wherein the outlet orifice is in communication with the interior of the hollow boss, and the recess in the flat closed wall of the cap includes a pair of opposing stream leg portions shorter than the diameter of the core, and the recess includes a pair of wing portions angularly spaced from the leg portions and being of slightly greater length than the diameter of the core.

* * * * *

UNITED STATES PATENT OFFICE

CERTIFICATE OF CORRECTION

PATENT NO. : 3,967,765

DATED : July 6, 1976

INVENTOR(S) : Lewis A. Micallef

It is certified that error appears in the above-identified patent and that said Letters Patent are hereby corrected as shown below:

Column 4, line 32, "form" should be --from--; and

Column 4, line 67, "portions" should be --positions--.

Signed and Sealed this

Twenty-first Day of September 1976

[SEAL]

*Attest:*

RUTH C. MASON
*Attesting Officer*

C. MARSHALL DANN
*Commissioner of Patents and Trademarks*